US011610482B2

(12) United States Patent
Gaurav et al.

(10) Patent No.: US 11,610,482 B2
(45) Date of Patent: Mar. 21, 2023

(54) SYSTEM TO WARN A MOTORIST OF THE PRESENCE OF A PEDESTRIAN IN A CROSSWALK AT A TRAFFIC INTERSECTION

(71) Applicants: Vihaan Gaurav, Charlotte, NC (US); Tanuj Karthikeyan, Charlotte, NC (US); Mihika Kiran, Concord, NC (US); Namit Vernekar, Charlotte, NC (US); Shikha Gaurav, Charlotte, NC (US); Vishal Gaurav, Charlotte, NC (US)

(72) Inventors: Vihaan Gaurav, Charlotte, NC (US); Tanuj Karthikeyan, Charlotte, NC (US); Mihika Kiran, Concord, NC (US); Namit Vernekar, Charlotte, NC (US); Shikha Gaurav, Charlotte, NC (US); Vishal Gaurav, Charlotte, NC (US)

( * ) Notice: Subject to any disclaimer, the term of this patent is extended or adjusted under 35 U.S.C. 154(b) by 157 days.

(21) Appl. No.: 17/197,410

(22) Filed: Mar. 10, 2021

(65) Prior Publication Data

US 2021/0287533 A1 Sep. 16, 2021

Related U.S. Application Data

(60) Provisional application No. 62/990,409, filed on Mar. 16, 2020.

(51) Int. Cl.
*G08G 1/07* (2006.01)

(52) U.S. Cl.
CPC ..... *G08G 1/07* (2013.01)

(58) Field of Classification Search
CPC ..... G08G 1/07; G08G 1/095; G08G 1/005; G08G 1/052; G08G 1/166; G08G 1/08; G08G 1/09; G08G 1/075; G08G 1/0145; G08G 1/087; G08G 1/096; G08G 1/16
See application file for complete search history.

(56) References Cited

U.S. PATENT DOCUMENTS

| | | | |
|---|---|---|---|
| 5,406,276 | A | 4/1995 | Ogle |
| 5,559,509 | A | 9/1996 | Ogle |
| 5,572,202 | A | 11/1996 | Regel et al. |
| 5,734,339 | A | 3/1998 | Ogle |
| 6,384,742 | B1 | 5/2002 | Harrison |
| 7,777,646 | B2 | 8/2010 | Konforty et al. |

(Continued)

*Primary Examiner* — Sisay Yacob
(74) *Attorney, Agent, or Firm* — Jeffrey C. Watson; Grell & Watson Patent Attorneys LLC

(57) ABSTRACT

A system to warn a motorist of the presence of a pedestrian in a crosswalk at a traffic intersection includes at least one standard traffic signal configured for directing motorists through the traffic intersection. At least one standard walk light is included and configured for directing pedestrians for use on the crosswalk at the traffic intersection. At least one additional pedestrian warning signal is also included and configured to face the motorists. Each of the at least one additional pedestrian warning signals is in communication with the at least one standard traffic signal and the at least one standard walk light. Wherein, each of the at least one additional pedestrian warning signals is configured to warn the motorist of a certain presence of the pedestrian at the traffic intersection who are either about to cross or already crossing the traffic intersection.

18 Claims, 3 Drawing Sheets

(56) References Cited

U.S. PATENT DOCUMENTS

| | | | | |
|---|---|---|---|---|
| 8,947,265 | B2 | 2/2015 | Bernard et al. | |
| 10,068,473 | B1 | 9/2018 | Harrison et al. | |
| 2005/0128105 | A1 | 6/2005 | Green et al. | |
| 2008/0018494 | A1 | 1/2008 | Waite et al. | |
| 2010/0214127 | A1 | 8/2010 | Lloyd et al. | |
| 2012/0319868 | A1 | 12/2012 | Kupczyn | |
| 2015/0154860 | A1* | 6/2015 | Holzwanger | G08G 1/0967 340/944 |
| 2019/0001884 | A1 | 1/2019 | Lopez-Hinojosa et al. | |
| 2019/0035262 | A1* | 1/2019 | Brady | G08G 1/005 |
| 2019/0035263 | A1* | 1/2019 | Loes | G08G 1/095 |
| 2019/0061611 | A1* | 2/2019 | Dellock | B60Q 1/2665 |
| 2019/0197883 | A1* | 6/2019 | Camras | H05B 47/115 |
| 2020/0090500 | A1* | 3/2020 | Aladas | G08G 1/07 |
| 2020/0388158 | A1* | 12/2020 | Tate | G08G 1/166 |

* cited by examiner

SYSTEM TO WARN A MOTORIST OF THE PRESENCE OF A PEDESTRIAN IN A CROSSWALK AT A TRAFFIC INTERSECTION

CROSS-REFERENCE TO RELATED APPLICATIONS

This application claims benefit of priority application, U.S. Provisional Ser. No. 62/990,409 filed Mar. 16, 2020 entitled "System for Motorists to Determine Pedestrian Presence at Traffic Intersections", which is incorporated herein by reference in its entirety.

FIELD OF THE DISCLOSURE

The present disclosure is directed to a system for the determination and alerting of pedestrian's at traffic intersections for motorists to react to, in advance. More specifically, the present disclosure is related to a system to warn a motorist of the presence of a pedestrian in a crosswalk at a traffic intersection that may be designed to provide more safety for pedestrians at high-volume traffic intersections.

BACKGROUND

Generally speaking, an intersection is an at-grade junction where two or more roads or streets meet or cross. Intersections may be classified by the number of road segments, traffic controls or lane design. In general, there are two types of intersections including signalized and unsignalized intersections. The instant disclosure may be directed toward signalized traffic intersections. Signal-controlled intersections depend on traffic signals, usually electric, which indicate which traffic is allowed to proceed at any particular time Intersections generally must manage pedestrian as well as vehicle traffic. Pedestrian aids include crosswalks, pedestrian-directed traffic signals ("walk light") and over/underpasses. Traffic signals can be time consuming to navigate, especially if programmed to priorities vehicle flow over pedestrians, while over and underpasses which rely on stairs are inaccessible to those who can't climb them. Walk lights may be accompanied by audio signals to aid the visually impaired. Medians can offer pedestrian islands, allowing pedestrians to divide their crossings into a separate segment for each traffic direction, possibly with a separate signal for each.

One of the problems of signalized traffic intersections is the danger and accidents involving pedestrians. Existing traffic signal system is to co-ordinate vehicle movements at the intersections. Existing pedestrian signals are to let pedestrian know when it is safe to cross. However, there is no system/function currently to inform motorists of pedestrian presence at intersection. Accordingly, there is clearly a need and desire to provide a safer way of managing pedestrian as well as vehicle traffic at such signalized traffic intersections.

Some intersections display red lights in all directions for a period of time. This may be as a pedestrian scramble. This type of vehicle all-way stop allows pedestrians to cross safely in any direction, including diagonally. Although this all red lights configuration is safer for the pedestrians, the downside is that it is very inefficient for traffic flow.

Therefore, a need exists for a safer way for managing pedestrian as well as vehicle traffic at signalized traffic intersections that is not only safe for the pedestrians, but also efficient for traffic flow.

The instant disclosure may be designed to address at least certain aspects of the problems or needs discussed above by providing a system to warn a motorist of the presence of a pedestrian in a crosswalk at a traffic intersection.

SUMMARY

Accordingly, in one aspect, the present disclosure embraces a system to warn a motorist of the presence of a pedestrian in a crosswalk at a traffic intersection. The system generally includes at least one standard traffic signal, at least one standard walk light, and at least one additional pedestrian warning signal. The at least one standard traffic signal may be configured for directing motorists through the traffic intersection. The at least one standard walk light may be configured for directing pedestrians for use on the crosswalk at the traffic intersection. The at least one additional pedestrian warning signal includes a pedestrian light that may face the motorists. The pedestrian light of each of the at least one additional pedestrian warning signals is in communication with the at least one standard traffic signal and the at least one standard walk light. Wherein, the pedestrian light of each of the at least one additional pedestrian warning signals is configured to warn the motorist of a certain presence of the pedestrian at the traffic intersection who are either about to cross or already crossing the traffic intersection.

One feature of the disclosed system to warn a motorist of the presence of a pedestrian in a crosswalk at a traffic intersection may be that each of the at least one additional pedestrian warning signals may be configured to warn the motorist of the certain presence of the pedestrian at the traffic intersection who are either about to cross or already crossing the traffic intersection via the communication with the at least one standard traffic signal and the at least one standard walk light.

Another feature of the disclosed system to warn a motorist of the presence of a pedestrian in a crosswalk at a traffic intersection may be that each of said at least one additional pedestrian warning signals may be configured to function along with an existing traffic signal system.

In select embodiments of the disclosed system to warn a motorist of the presence of a pedestrian in a crosswalk at a traffic intersection, the pedestrian light of each of the at least one additional pedestrian warning signals may include a color code and a blinking feature. Wherein, the pedestrian light of each of the additional pedestrian warning signals may be white in color and may have a signaling feature configured to switch on solid or blinking. The blinking white signal of the pedestrian light may be configured to catch attention of the motorists and explicitly let the motorists know that the pedestrian is crossing the traffic intersection via the crosswalk.

Another feature of the disclosed system to warn a motorist of the presence of a pedestrian in a crosswalk at a traffic intersection may be that the system may be configured where the motorists know that jumping a red signal will hurt a pedestrian.

Another feature of the disclosed system to warn a motorist of the presence of a pedestrian in a crosswalk at a traffic intersection may be that the system may be configured to provide awareness of pedestrian presence at the traffic intersection due to a blinking white signal.

Another feature of the disclosed system to warn a motorist of the presence of a pedestrian in a crosswalk at a traffic intersection may be that the system may be configured to enable motorists to be more attentive or less distracted while taking left or right turns.

Another feature of the disclosed system to warn a motorist of the presence of a pedestrian in a crosswalk at a traffic intersection may be that the system may be configured to warn and inform motorists trying to take a right turn at the intersection.

Another feature of the disclosed system to warn a motorist of the presence of a pedestrian in a crosswalk at a traffic intersection may be that the system may be configured to warn and inform motorists trying to take a left turn at the intersection.

Another feature of the disclosed system to warn a motorist of the presence of a pedestrian in a crosswalk at a traffic intersection may be that the system may be configured to provide awareness of possible pedestrian conflict that will enable the motorists to be cautious thereby leading to the traffic intersection being safer for the pedestrian.

Another feature of the disclosed system to warn a motorist of the presence of a pedestrian in a crosswalk at a traffic intersection may be that the system may be configured to alert the motorists to approach intersections with extra caution even if the pedestrian is not directly visible as they will be aware of certain presence of the pedestrian.

Another feature of the disclosed system to warn a motorist of the presence of a pedestrian in a crosswalk at a traffic intersection may be that the system may be configured to alert motorists to know pedestrian presence even if they are blocked from their line of sight due to vehicles in a left lane.

Another feature of the disclosed system to warn a motorist of the presence of a pedestrian in a crosswalk at a traffic intersection may be that the system may be configured to alert motorists to know pedestrian presence even if they are blocked from their line of sight due to vehicles in a right lane.

In select embodiments of the disclosed system to warn a motorist of the presence of a pedestrian in a crosswalk at a traffic intersection each of the at least one standard traffic signals may include a red light, a yellow light and a green light. The red light may be configured to alert the motorists to stop. The yellow light may be configured to alert the motorists to proceed with caution as the red light is about to turn on. And the green light may be configured to alert the motorists to proceed through the intersection. In addition, each of the at least one standard walk lights may include a solid hand light, a walking person light, and a blinking hand light. The solid hand light may be configured to alert the pedestrian to not walk across the intersection and to push a button to cross. The solid hand light may be configured to remain on until traffic has stopped. The walking person light may be configured to alert the pedestrian to start crossing the crosswalk but to look for traffic from both directions prior to crossing. The blinking hand light may be configured to alert the pedestrian crossing the crosswalk to continue crossing but that time is running out. The solid hand light may be configured to come on after the time runs out on the blinking hand light. Wherein, when the green light is on the at least one standard traffic signal and the solid hand light is on the at least one standard walk light, the pedestrian light of the at least one additional pedestrian warning signal may be configured to be off, whereby the motorists may be alerted to continue driving through the traffic intersection or turn right with caution, and the pedestrian is alerted to not cross the crosswalk and push the button to cross. When the yellow light is on the at least one standard traffic signal and the solid hand light is on the at least one standard walk light, the pedestrian light of the at least one additional pedestrian warning signal may be configured to be solid, whereby the motorists may be alerted to stop if safe to do so, and the pedestrian is alerted to continue waiting as traffic is beginning to stop. When the red light is on the at least one standard traffic signal and the walking person light is on the at least one standard walk light, the pedestrian light of the at least one additional pedestrian warning signal may be configured to flash, whereby the motorists may be alerted to stop and remain stopped as the pedestrian is in the crosswalk, and the pedestrian may be alerted to start crossing the crosswalk while looking for traffic from both directions prior to crossing. When the red light is on the at least one standard traffic signal and the blinking hand light is on the at least one standard walk light, the pedestrian light of the at least one additional pedestrian warning signal may be configured to flash, whereby the motorists may be alerted to stop and remain stopped as the pedestrian is in the crosswalk, and the pedestrian may be alerted to continue crossing. When the yellow light is blinking on the at least one standard traffic signal for an unprotected left turn, and the walking person light or blinking hand is on the at least one standard walk light, the pedestrian light of the at least one additional pedestrian warning signal may be configured to flash, whereby the motorists may be alerted of presence of the pedestrian on a left crosswalk on the intersection.

In select embodiments of the disclosed system to warn a motorist of the presence of a pedestrian in a crosswalk at a traffic intersection, the pedestrian light of the at least one additional pedestrian warning signal may be configured to blink and be activated when the pedestrian push button is pressed only when the red light is on the at least one standard traffic signal. Whereby the pedestrian light of the at least one additional pedestrian warning signal will not switch on when the green light or the yellow light is on the at least one standard traffic signal.

In select embodiments of the disclosed system to warn a motorist of the presence of a pedestrian in a crosswalk at a traffic intersection, when the solid hand light is on the at least one standard walk light, the pedestrian light of the at least one additional pedestrian warning signal will turn off and not be visible to the motorists.

In select embodiments of the disclosed system to warn a motorist of the presence of a pedestrian in a crosswalk at a traffic intersection, the pedestrian light of the at least one additional pedestrian warning signal may be built into the at least one standard traffic signal configured for directing motorists through the traffic intersection.

In other select embodiments of the disclosed system to warn a motorist of the presence of a pedestrian in a crosswalk at a traffic intersection, the pedestrian light of the at least one additional pedestrian warning signal may be provided separate from the at least one standard traffic signal, where both the at least one additional pedestrian warning signal and the separate at least one standard traffic signal may be visible to the motorists and may be configured for directing motorists through the traffic intersection.

In another aspect, the disclosed system to warn a motorist of the presence of a pedestrian in a crosswalk at a traffic intersection may be provided in any of the embodiments and/or combinations of embodiments shown and/or described herein.

In another aspect, the disclosure embraces the pedestrian warning signal of the disclosed system to warn a motorist of the presence of a pedestrian in a crosswalk at a traffic intersection. The pedestrian warning signal may be provided in any of the embodiments and/or combination of embodiments shown and/or described herein with the disclosed system to warn a motorist of the presence of a pedestrian in a crosswalk at a traffic intersection. In general, the pedestrian warning signal may include a pedestrian light visible to a motorist at a traffic intersection. The pedestrian light may be configured to be off, to be solid, and to blink. The pedestrian light may be in communication with at least one standard traffic signal configured for directing motorists through the traffic intersection. The pedestrian light may also be in communication with at least one standard walk light configured for directing pedestrians for use on the crosswalk at the traffic intersection. Wherein, the pedestrian light may be configured to warn the motorist of a certain presence of the pedestrian at the traffic intersection who are either about to cross or already crossing the traffic intersection.

One feature of the disclosed pedestrian warning signal may be that it can be configured to function along with an existing traffic signal system.

In select embodiments of the disclosed pedestrian warning signal, the pedestrian light may include a color code and a blinking feature. In select embodiments, the pedestrian light may be white in color and may have a signaling feature configured to switch on solid or blinking. The blinking white signal may be configured to catch attention of the motorist and explicitly let the motorists know that the pedestrian is crossing the traffic intersection via the crosswalk.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Figure 1:
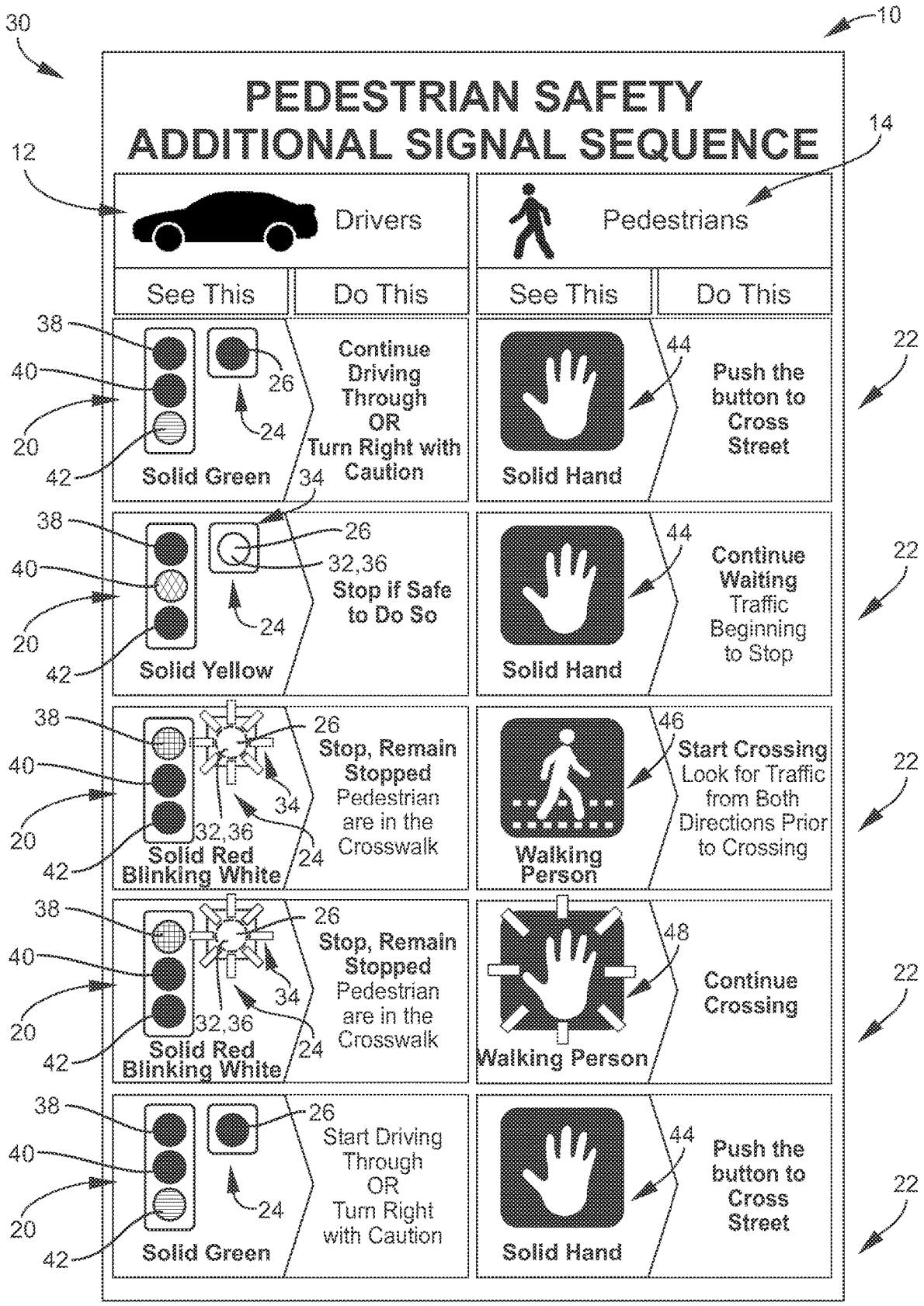
FIG. 1 is a sequence diagram for the disclosed system to warn a motorist of the presence of a pedestrian in a crosswalk at a traffic intersection that shows the standard traffic signal, the standard walking signal, and the additional pedestrian warning signal with the white solid/blinking pedestrian light. Since a pedestrian has pushed the button showing an intent to use the crosswalk at an intersection, the 2nd sequence shows the solid white light switching on when the light for motorists turn yellow from red. This way, the motorists know a definite presence of a pedestrian at the intersection with an intention to cross. In the 3rd sequence, when the light turns to red for motorists, the white pedestrian light will start blinking. At the same time, standard walking signal will switch on for pedestrians to start crossing.
Figure 2:
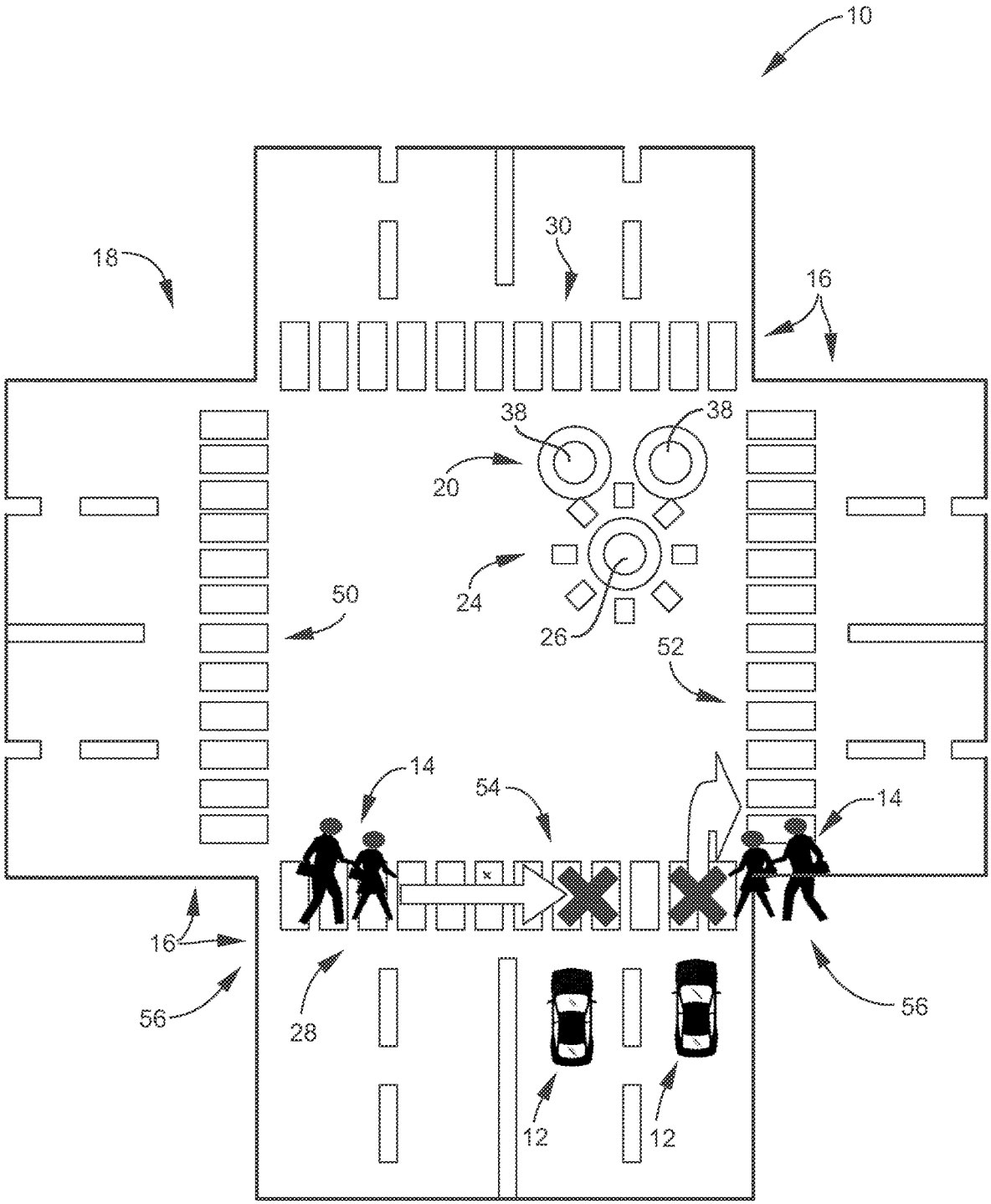
FIG. 2 is an illustration of the situations that will be avoided when motorists are warned/informed of pedestrians crossing the perpendicular intersection in the front via the disclosed system to warn a motorist of the presence of a pedestrian in a crosswalk at a traffic intersection. This warning or information is in the form of the red light of the standard traffic signal and the white solid/blinking pedestrian light of the disclosure appearing at the same time. The left X symbol is a situation when the car in the left lane may try to jump the signal hurting pedestrian approaching from both sides. The right X symbol is another situation when the car in the right lane may not be able to see pedestrians from left due to blockage of their line of sight by the car in the left lane.
Figure 3:
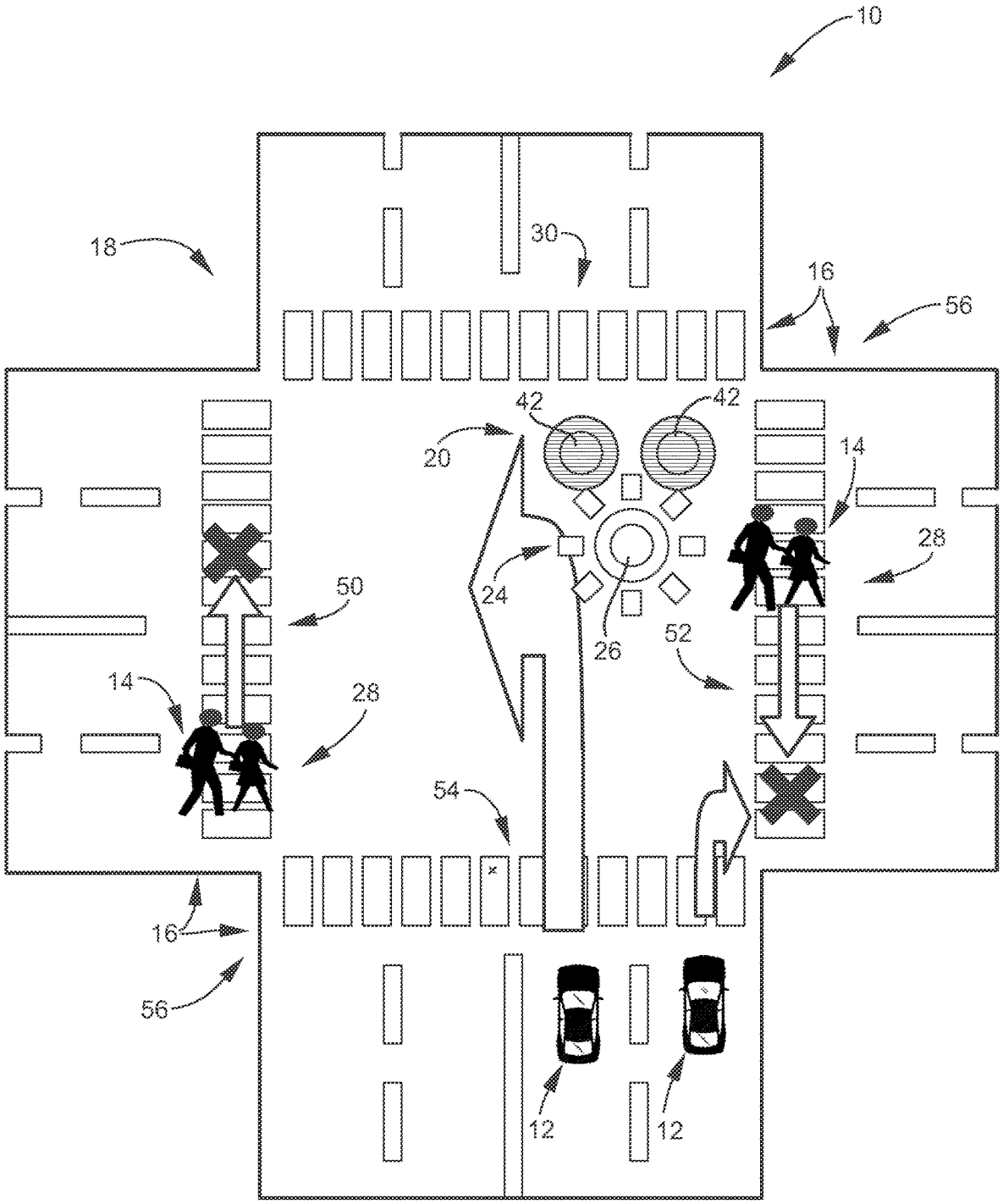
FIG. 3 is an illustration of the situations that will be avoided when motorists are warned/informed of pedestrians crossing the intersection at the left or right via the disclosed system to warn a motorist of the presence of a pedestrian in a crosswalk at a traffic intersection. This warning or information is in the form of the green light of the standard traffic signal and the white solid/blinking pedestrian light of the disclosure appearing at the same time. The left X symbol is a situation when the car in the right lane will try to take left turn hurting pedestrian on the left side crosswalk. The right X symbol is another situation when the car in the right lane will try to take right turn hurting pedestrians on the right side crosswalk.

Referring now to FIGS. 1-3, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring to FIGS. 1-3, system 10 is shown. System 10 may be designed and configured to warn motorist 12 of the presence of pedestrian 14 in crosswalk 16 at traffic intersection 18. System 10 may generally include at least one standard traffic signal 20, at least one standard walk light 22, and at least one additional pedestrian warning signal 24. The at least one standard traffic signal 20 may be provided for each direction or lane of traffic at traffic intersection 18. Each standard traffic signal 20 may be configured for directing motorists 12 through traffic intersection 18. The at least one standard walk light 22 may be provided on each side of each crosswalk 16 of traffic intersection 18. Each standard walk light 22 may be configured for directing pedestrians 14 for use on crosswalk 16 at traffic intersection 18. The at least one additional pedestrian warning signal 24 may include pedestrian light 26. Pedestrian light 26 may be designed and configured to face motorists 12 approaching traffic intersection 18. As such, the at least one additional pedestrian warning signal 24 with pedestrian light 26 may be provided on each direction or lane of traffic at traffic intersection 18. Pedestrian light 26 of each of the at least one additional pedestrian warning signals 24 may be in communication with each of the at least one standard traffic signals 20 and each of the at least one standard walk lights 22. Wherein, pedestrian light 26 of each of the at least one additional pedestrian warning signals 24 may be configured to warn motorist 12 of certain presence 28 of pedestrian 14 at traffic intersection 18 who are either about to cross or already crossing traffic intersection 18, like as shown in FIGS. 2 and 3.

One feature of system 10 to warn motorist 12 of the presence of pedestrian 14 in crosswalk 16 at traffic intersection 18 may be that each of the at least one additional pedestrian warning signals 24 may be configured to warn motorist 12 of certain presence 28 of pedestrian 14 at traffic intersection 18 who are either about to cross or already crossing traffic intersection 18 via the communication with each of the at least one standard traffic signals 20 and each of the at least one standard walk lights 22. The communication between the additional pedestrian warning signal 24 and the standard traffic signals 20 and standard walk lights 22 may be by any means, including, but not limited to, by a wired communication or by a wireless communication.

Another feature of system 10 to warn motorist 12 of the presence of pedestrian 14 in crosswalk 16 at traffic intersection 18 may be that each of the at least one additional pedestrian warning signals 24 may be configured to function along with existing traffic signal system 30, like as shown in FIGS. 1-3. As such, system 10 may be retrofitted to any existing traffic signal system 30. Or, system 10 may be included in any new traffic signal system 30.

Each of the additional pedestrian warning signals 24 may include pedestrian light 26. Pedestrian light 26 of each of the additional pedestrian warning signals 24 may be designed and configured to catch the attention of motorists 12 as they approach traffic intersection 18. Pedestrian light 26 of each of the additional pedestrian warning signals 24 may be designed and configured to alert such motorists 12 of certain presence 28 of pedestrian 14 or multiple pedestrians 14 in crosswalk 16 where motorist 12 may be approaching or turning across. Pedestrian light 26 may be designed and configured with any style or design configured to catch the attention of motorists 12 as they approach traffic intersection 18 and to provide the alert to motorists 12 of certain presence 28 of pedestrians 14 in crosswalks 16. In select embodiments, pedestrian light 26 of each of the additional pedestrian warning signals 24 may include color code 32 and signaling or blinking feature 34. Color code 32 may be any desired color or code used to alert and indicate to motorists 12 of certain presence 28 of pedestrians 14 in crosswalks 16. Signaling or blinking feature 34 may allow pedestrian light 26 to blink or signal to motorists 12 of certain presence 28 of pedestrians 14 in crosswalks 16 to aid in alerting and gaining the attention of approaching motorists 12. In select possibly preferred embodiments, pedestrian light 26 of each of the additional pedestrian warning signals 24 may be white 36 in color and may have signaling feature 34 configured to switch on solid white color 36 or blinking white color 36. The blinking white signal of pedestrian light 26 may be configured to catch attention of motorists 12 and explicitly let motorists 12 know that pedestrian 14 is crossing traffic intersection 18 via the associated crosswalk 16 of additional pedestrian warning signal 24.

Another feature of system 10 to warn motorist 12 of the presence of pedestrian 14 in crosswalk 16 at traffic intersection 18 may be that system 10 may be configured where motorists 12 know that jumping a red signal of standard traffic signal 20 will hurt pedestrian 14.

Another feature of system 10 to warn motorist 12 of the presence of pedestrian 14 in crosswalk 16 at traffic intersection 18 may be that system 10 may be configured to provide awareness of pedestrian 14 presence at traffic intersection 18 due to blinking white 36 signal of pedestrian light 26.

Another feature of system 10 to warn motorist 12 of the presence of pedestrian 14 in crosswalk 16 at traffic intersection 18 may be that system 10 may be configured to enable motorists 12 to be more attentive or less distracted while taking left or right turns.

Another feature of system 10 to warn motorist 12 of the presence of pedestrian 14 in crosswalk 16 at traffic intersection 18 may be that system 10 may be configured to warn and inform motorists 12 trying to take a right turn at traffic intersection 18.

Another feature of system 10 to warn motorist 12 of the presence of pedestrian 14 in crosswalk 16 at traffic intersection 18 may be that system 10 may be configured to warn and inform motorists trying to take a left turn at traffic intersection 18.

Another feature of system 10 to warn motorist 12 of the presence of pedestrian 14 in crosswalk 16 at traffic intersection 18 may be that system 10 may be configured to provide awareness of possible pedestrian 14 conflict that will enable motorists 12 to be cautious thereby leading to traffic intersection 18 being safer for pedestrian 14.

Another feature of system 10 to warn motorist 12 of the presence of pedestrian 14 in crosswalk 16 at traffic intersection 18 may be that system 10 may be configured to alert motorists 12 to approach traffic intersection 18 with extra caution even if pedestrian 14 is not directly visible as they will be aware of certain presence 28 of such pedestrian 14 or pedestrians 14.

Another feature of system 10 to warn motorist 12 of the presence of pedestrian 14 in crosswalk 16 at traffic intersection 18 may be that system 10 may be configured to alert motorists 12 to know certain presence 28 of pedestrian 14 or pedestrians 14 even if they are blocked from their line of sight due to vehicles in a left lane.

Another feature of system 10 to warn motorist 12 of the presence of pedestrian 14 in crosswalk 16 at traffic intersection 18 may be that system 10 may be configured to alert motorists 12 to know certain presence 28 of pedestrian 14 or pedestrians 14 even if they are blocked from their line of sight due to vehicles in a right lane.

Referring now specifically to FIG. 1, in select embodiments of the disclosed system 10 to warn motorist 12 of the presence of pedestrian 14 in crosswalk 16 at traffic intersection 18, each of the at least one standard traffic signals 20 may include red light 38, yellow light 40 and green light 42. As is common and standard with currently used traffic signals, red light 38 may be configured to alert motorists 12 to stop. Yellow light 40 may be configured to alert motorists 12 to proceed with caution as red light 38 is about to turn on. And green light 42 may be configured to alert motorists 12 to proceed through traffic intersection 18. In addition, as is also common and standard with currently used crosswalk signals, each of the at least one standard walk lights 22 may include solid hand 44, walking person 46, and blinking hand 48. Solid hand 44 may be configured to alert pedestrian 14 to not walk across intersection 18 and to push button 56 to cross. Solid hand 44 may be configured to remain on until traffic has stopped. Walking person 46 may be configured to alert pedestrian 14 to start crossing crosswalk 16 but to look for traffic from both directions prior to crossing. Blinking hand 48 may be configured to alert pedestrian 14 crossing crosswalk 16 to continue crossing but that time is running out. Solid hand 44 may be configured to come on after the time runs out on blinking hand 48.

Referring specifically to the signal sequence shown in FIG. 1, in the first row, when green light 42 is on the at least one standard traffic signal 20 and solid hand 44 is on the at least one standard walk light 22, pedestrian light 26 of the at least one additional pedestrian warning signal 24 may be configured to be off, whereby motorists 12 may be alerted to continue driving through traffic intersection 18 or turn right with caution, and pedestrian 14 is alerted to not cross crosswalk 16 and push button 56 to cross. As shown in the second row of FIG. 1, when yellow light 40 is on the at least one standard traffic signal 20 and solid hand 44 is on the at least one standard walk light 22, pedestrian light 26 of the at least one additional pedestrian warning signal 24 may be configured to be solid, whereby motorists 12 may be alerted to stop if safe to do so, and pedestrian 14 is alerted to continue waiting as traffic is beginning to stop. As shown in the third row of FIG. 1, when red light 38 is on the at least one standard traffic signal 20 and walking person 46 is on the at least one standard walk light 22, pedestrian light 26 of the at least one additional pedestrian warning signal 24 may be configured to flash (possibly preferably flash white 36), whereby motorists 12 may be alerted to stop and remain stopped as pedestrian 14 is in crosswalk 16, and pedestrian 14 may be alerted to start or continue crossing crosswalk 16 while looking for traffic from both directions prior to crossing. As shown in the fourth row of FIG. 1, when red light 38 is on the at least one standard traffic signal 20 and the blinking hand 48 is on the at least one standard walk light 22, pedestrian light 26 of the at least one additional pedestrian warning signal 24 may be configured to flash (possibly preferably flash white 36), whereby motorists 12 may be alerted to stop and remain stopped as pedestrian 14 is in crosswalk 16, and pedestrian 14 may be alerted to continue crossing. As shown in the fifth row of FIG. 1, which starts the process over similar to the first row in FIG. 1, when green light 42 is back on the at least one standard traffic signal 20 and solid hand 44 is on the at least one standard walk light 22, pedestrian light 26 of the at least one additional pedestrian warning signal 24 may be configured to be off, whereby motorists 12 may be alerted to continue driving through traffic intersection 18 or turn right with caution, and pedestrian 14 is alerted to not cross crosswalk 16 and push button 56 to cross. In another situation, not specifically shown in FIG. 1, when yellow light 40 is blinking on the at least one standard traffic signal 20, like for an unprotected left turn, and walking person 46 or blinking hand 48 is on the at least one standard walk light 22, pedestrian light 26 of the at least one additional pedestrian warning signal 24 may be configured to flash (possibly preferably flash white 36), whereby motorists 12 may be alerted of certain presence 28 of pedestrian 14 on left crosswalk 50 on traffic intersection 18 (or right crosswalk 52 if yellow light 40 is blinking for an unprotected right turn).

Accordingly, in select embodiments of system 10 to warn motorist 12 of the presence of pedestrian 14 in crosswalk 16 at traffic intersection 18, pedestrian light 26 of the at least one additional pedestrian warning signal 24 may be configured to blink and be activated when pedestrian 14 pushes button 56 only when red light 38 is on the at least one standard traffic signal 20. Whereby pedestrian light 26 of the at least one additional pedestrian warning signal 24 will not switch on when green light 42 or yellow light 40 is on the at least one standard traffic signal 20. In addition, when solid hand 44 is on the at least one standard walk light 22, pedestrian light 26 of the at least one additional pedestrian warning signal 24 will turn off and not be visible to motorists 12.

In select embodiments of the disclosed system 10 to warn motorist 12 of the presence of pedestrian 14 in crosswalk 16 at traffic intersection 18, pedestrian light 26 of the at least one additional pedestrian warning signal 24 may be built into the at least one standard traffic signal 20 configured for directing motorists 12 through traffic intersection 18. In other select embodiments, as shown in FIG. 1, pedestrian light 26 of the at least one additional pedestrian warning signal 24 may be provided separate from the at least one standard traffic signal 20, where both the at least one additional pedestrian warning signal 24 and the separate at least one standard traffic signal 20 may be visible to motorists 12 and may be configured for directing motorists through traffic intersection 18.

In another aspect, system 10 to warn motorist 12 of the presence of pedestrian 14 in crosswalk 16 at traffic intersection 18 may be provided in any of the embodiments and/or combinations of embodiments shown and/or described herein.

In another aspect, the disclosure embraces pedestrian warning signal 24 of system 10 to warn motorist 12 of the presence of pedestrian 14 in crosswalk 16 at traffic intersection 18. Pedestrian warning signal 24 may be provided in any of the embodiments and/or combination of embodiments shown and/or described herein with system 10 to warn motorist 12 of the presence of pedestrian 14 in crosswalk 16 at traffic intersection 18. In general, pedestrian warning signal 24 may include pedestrian light 26 visible to motorist 12 at traffic intersection 18. Pedestrian light 26 may be configured to be off, to be solid, and to blink. Pedestrian light 26 may be in communication with at least one standard traffic signal 20 configured for directing motorists through traffic intersection 18. Pedestrian light 26 may also be in communication with at least one standard walk light 22 configured for directing pedestrians 14 for use on crosswalk 16 (front crosswalk 54, left crosswalk 50, and/or right crosswalk 52) at traffic intersection 18. Wherein, pedestrian light 26 may be configured to warn motorist 12 of certain presence 28 of pedestrian 14 at traffic intersection 18 who are either about to cross or already crossing traffic intersection 18 via one of the associated crosswalks 16.

One feature of the disclosed pedestrian warning signal 24 may be that it can be configured to function along with existing traffic signal system 30.

In select embodiments of the disclosed pedestrian warning signal 24, pedestrian light 26 may include color code 32 and/or blinking or signaling feature 34. In select possibly preferred embodiments, pedestrian light 26 may be white 36 in color and may have signaling feature 34 configured to switch on solid white or blinking white. The blinking white signal may be configured to catch attention of motorist 12 and explicitly let motorists 12 know that pedestrian 14 is crossing traffic intersection 18 via one of the associated crosswalks 16.

In sum, the disclosed system 10 to warn motorist 12 of the presence of pedestrian 14 in crosswalk 16 at traffic intersection 18 includes an additional white traffic light (pedestrian light 26 of additional pedestrian warning signal 24) along with the existing three-light traffic signal system. The inventive system will work along side the existing three-light traffic signal system and other traffic devices like pedestrian push button and pedestrian pressure plates. In use, system 10 may warn motorists 12 of certain presence 28 of pedestrians 14 at a traffic intersection 18 who are either about to cross or already crossing the intersection. The additional pedestrian warning signal 24 may preferably be white in color and will have a feature to switch on solid or blinking. The blinking white signal may be designed to catch motorists' attention and explicitly let motorists 12 know that pedestrian 14 is crossing. Motorists 12 will now know that jumping the red signal (even in haste) will hurt a pedestrian. Awareness of pedestrian presence at intersections (due to blinking white signal) may enable motorists to be more attentive (less distracted) while taking left or right turns.

A feature of the present disclosure is its ability to warn/inform oncoming motorists of presence of pedestrian at the intersection and a possible risk of hurting the pedestrian if trying to jump the yellow/red light.

Another feature of the present disclosure is its ability to warn/inform motorists trying to take a left turn at the intersection. When it is an unprotected left turn (blinking yellow left arrow) for the motorist, the new system will help to additionally inform of presence of pedestrian on left crosswalk on the intersection.

Another feature of the present disclosure is its ability to warn/inform motorists trying to take a right turn at the intersection. When it is solid green signal for through traffic, motorists on right lane may make a right turn cautiously. The disclosure will help motorists not to attempt right turn in case of certain presence of pedestrian on the crosswalk at right.

Our disclosure may be an additional blinking white signal next to existing red signal for motorists. The blinking white light will let motorists know explicitly that a pedestrian is crossing.

Our disclosure may utilize the existing three light traffic signal cycle, Green-Yellow-Red. During this cycle, the blinking white signal will get activated on pressing the pedestrian push button and only when the red light is on. The white light will not switch on when motorists' signal is Green or Yellow.

Our disclosure may function in-sync with existing pedestrian signals that lets pedestrians know that it's safe to cross the road. This will indicate to motorists that pedestrians are on a crosswalk. Accordingly, when pedestrian light turns to "Do Not Cross" sign, blinking white signal will turn off for motorists.

How it solves the problem: The blinking white signal will catch motorists' attention and explicitly let motorists know that a pedestrian is crossing. Motorists will now know jumping the red signal (even in haste) will hurt a pedestrian. Awareness of pedestrian presence at intersections (due to blinking white signal) will enable motorists to be more attentive (less distracted) while taking left or right turns. Awareness of possible pedestrian conflict will enable motorists to be cautious (Human Behavior) leading to safer intersections for pedestrians.

Few Scenarios Our Solution Will Solve:

a. Motorists run through red light at signalized intersections—With blinking white signal, motorists will be aware of certainty of crash if they jump red signal, this will prompt them to stop and respect red light.

b. Motorists did not see pedestrians in time to stop—With blinking white signal, motorists will approach intersections with extra caution even if pedestrians are not directly visible as they will be aware of certain presence of pedestrians.

c. Conflict between pedestrian and right turning vehicle—Motorists focus mostly on through traffic or pedestrians on motorist's right when motorists take right turn. With blinking white signal, motorists will know pedestrian presence even if they are blocked from their line of sight due to vehicles on the left lane.

d. Conflict between pedestrian and left turning vehicle—Motorists focus mostly on through traffic or pedestrians on motorist's left when motorists take left turn. With blinking white signal, motorists will know pedestrian presence even if they are blocked from their line of sight due to vehicles on the right lane.

How it Will Work with Future/Smart Systems:

a. Pedestrian Switch Pad functions same as pedestrian push button in identifying pedestrian presence. This will be integrated with our solution of a four-light signal like a pedestrian push button.

b. Accessibility—Sound enabled push buttons will function in-sync with blinking white signal to help impaired pedestrians.

c. Smart Cars—will recognize white signals in the same way as they identify other signals, Red-Yellow-Green. Smart cars will be programmed accordingly.

d. Futuristic Ped Crossings/Iota—With technology advancement in the traffic system, our solution can be upgraded and integrated with Iota (Internet of Things) solutions.

In use, the disclosed pedestrian identification system 10 will inform motorists a definite presence of pedestrians at intersections who are either crossing at or are about to cross the intersection. The motorists who are approaching the intersection for through traffic will get informed of the risk of chance of crash with pedestrian if they jump the red light. Similarly, the motorists who are trying to take a left or a right turn will know if a pedestrian is crossing or about to cross at the intersection. This will help in situations where pedestrians are not in the line of sight of the motorists.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are with the spirit and scope of the present disclosure, are contemplated thereby, and are intended to be covered by the following general description.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A system to warn a motorist of a certain presence of a pedestrian in a crosswalk at a traffic intersection comprising:

at least one standard traffic signal configured for directing the motorist through the traffic intersection, each of the at least one standard traffic signals including:

a red light configured to alert the motorist to stop;

a yellow light configured to alert the motorist to proceed with caution as the red light is about to turn on; and a green light configured to alert the motorist to proceed through the intersection;

at least one standard walk light configured for directing pedestrians for use on the crosswalk at the traffic intersection, each of the at least one standard walk lights including:

a solid hand light configured to alert the pedestrian to not walk across the intersection and to push a button to cross, the solid hand light is configured to remain on until traffic has stopped;

a walking person light configured to alert the pedestrian to start crossing the crosswalk but to look for traffic from both directions prior to crossing; and a blinking hand light configured to alert the pedestrian crossing the crosswalk to continue crossing but that a time is running out;

the solid hand light is configured to come on after the time runs out on the blinking hand light; and at least one additional pedestrian warning signal with a pedestrian light configured to face the motorist, each of the at least one additional pedestrian warning signals is in communication with the at least one standard traffic signal and the at least one standard walk light;

wherein, each of the at least one additional pedestrian warning signals is configured to warn the motorist of the certain presence of the pedestrian at the traffic intersection who are either about to cross or already crossing the traffic intersection.

2. The system of claim 1, wherein each of the at least one additional pedestrian warning signals is configured to warn the motorist of the certain presence of the pedestrian at the traffic intersection who are either about to cross or already crossing the traffic intersection via the communication with the at least one standard traffic signal and the at least one standard walk light.

3. The system of claim 1, wherein each of said at least one additional pedestrian warning signals is configured to function along with an existing traffic signal system.

4. The system of claim 1, wherein the pedestrian light of each of said at least one additional pedestrian warning signals include a color code and a blinking feature.

5. The system of claim 4, wherein the pedestrian light of each of the additional pedestrian warning signals is white in color and has a signaling feature configured to switch on solid or blinking, where the blinking of the white color of the pedestrian light is configured to catch attention of the motorists and explicitly let the motorists know that the pedestrian is crossing the traffic intersection via the crosswalk.

6. The system of claim 1, whereby:

the system is configured where the motorist know that jumping a red signal will hurt the pedestrian;

the system is configured to provide awareness of the certain presence of the pedestrian at the traffic intersection due to a blinking white signal;

the system is configured to enable the motorist to be more attentive or less distracted while taking left or right turns;

the system is configured to warn and inform the motorist trying to take a right turn at the intersection;

the system is configured to warn and inform the motorist trying to take a left turn at the intersection;

the system is configured to provide awareness of a possible conflict with the pedestrian that will enable the motorist to be cautious thereby leading to the traffic intersection being safer for the pedestrian;

the system is configured to alert the motorist to approach intersections with extra caution even if the pedestrian is not directly visible as they will be aware of certain presence of the pedestrian;

the system is configured to alert the motorist to know the certain presence of the pedestrian even if they are blocked from their line of sight due to vehicles in a left lane;

the system is configured to alert the motorist to know the certain presence of the pedestrian even if they are blocked from their line of sight due to vehicles in a right lane;

or combinations thereof.

7. The system of claim 1, wherein, when the green light is on the at least one standard traffic signal and the solid hand light is on the at least one standard walk light, the pedestrian light of the at least one additional pedestrian warning signal is configured to be off, whereby the motorist is alerted to continue driving through the traffic intersection or turn right with caution, and the pedestrian is alerted to not cross the crosswalk and push the button to cross.

8. The system of claim 1, wherein, when the yellow light is on the at least one standard traffic signal and the solid hand light is on the at least one standard walk light, the pedestrian light of the at least one additional pedestrian warning signal is configured to be solid, whereby the motorist is alerted to stop if safe to do so, and the pedestrian is alerted to continue waiting as traffic is beginning to stop.

9. The system of claim 1, wherein, when the red light is on the at least one standard traffic signal and the walking person light is on the at least one standard walk light, the pedestrian light of the at least one additional pedestrian warning signal is configured to flash, whereby the motorist is alerted to stop and remain stopped as the pedestrian is in the crosswalk, and the pedestrian is alerted to start crossing the crosswalk while looking for traffic from both directions prior to crossing.

10. The system of claim 1, wherein when the red light is on the at least one standard traffic signal and the blinking hand light is on the at least one standard walk light, the pedestrian light of the at least one additional pedestrian warning signal is configured to flash, whereby the motorist is alerted to stop and remain stopped as the pedestrian is in the crosswalk, and the pedestrian is alerted to continue crossing.

11. The system of claim 1, wherein, when the yellow light is blinking on the at least one standard traffic signal for an unprotected left turn, and the walking person light or blinking hand is on the at least one standard walk light, the pedestrian light of the at least one additional pedestrian warning signal is configured to flash, whereby the motorist is alerted of presence of the pedestrian on a left crosswalk on the intersection.

12. The system of claim 1, wherein:

when the pedestrian light of the at least one additional pedestrian warning signal is configured to blink and be activated when the pedestrian push button is pressed only when the red light is on the at least one standard traffic signal, whereby the pedestrian light of the at least one additional pedestrian warning signal will not switch on when the green light or the yellow light is on the at least one standard traffic signal; and when the solid hand light is on the at least one standard walk light, the pedestrian light of the at least one additional pedestrian warning signal will turn off and not be visible to the motorist.

13. The system of claim 1, wherein the pedestrian light of the at least one additional pedestrian warning signal is built into the at least one standard traffic signal configured for directing the motorist through the traffic intersection.

14. The system of claim 1, wherein the pedestrian light of the at least one additional pedestrian warning signal is separate from the at least one standard traffic signal, where both the at least one additional pedestrian warning signal and the separate at least one standard traffic signal are visible to the motorist and are configured for directing the motorist through the traffic intersection.

15. A system to warn a motorist of the presence of a pedestrian in a crosswalk at a traffic intersection comprising:

at least one standard traffic signal configured for directing the motorist through the traffic intersection, each of the at least one standard traffic signals including:

a red light configured to alert the motorist to stop;

a yellow light configured to alert the motorist to proceed with caution as the red light is about to turn on; and a green light configured to alert the motorist to proceed through the intersection;

at least one standard walk light configured for directing pedestrians for use on the crosswalk at the traffic intersection, each of the at least one standard walk lights including:

a solid hand light configured to alert the pedestrian to not walk across the intersection and to push a button to cross, the solid hand light is configured to remain on until traffic has stopped;

a walking person light configured to alert the pedestrian to start crossing the crosswalk but to look for traffic from both directions prior to crossing; and a blinking hand light configured to alert the pedestrian crossing the crosswalk to continue crossing but that a time is running out;

the solid hand light is configured to come on after the time runs out on the blinking hand light; and at least one additional pedestrian warning signal with a pedestrian light configured to face the motorist, each of the at least one additional pedestrian warning signals is in communication with the at least one standard traffic signal and the at least one standard walk light, each of said pedestrian light of the at least one additional pedestrian warning signals includes a color code and a blinking feature, where the pedestrian light of each of the additional pedestrian warning signals is white in color and has a signaling feature configured to switch on solid or blinking, where the blinking of the pedestrian light in the white color is configured to catch attention of the motorist and explicitly let the motorist know that the pedestrian is crossing the traffic intersection via the crosswalk;

the pedestrian light of the at least one additional pedestrian warning signal is separate from the at least one standard traffic signal, where both the at least one additional pedestrian warning signal and the separate at least one standard traffic signal are visible to the motorist and are configured for directing the motorist through the traffic intersection;

wherein, each of the at least one additional pedestrian warning signals is configured to warn the motorist of a certain presence of the pedestrian at the traffic intersection who are either about to cross or already crossing the traffic intersection;

wherein each of the at least one additional pedestrian warning signals is configured to warn the motorist of the certain presence of the pedestrian at the traffic intersection who are either about to cross or already crossing the traffic intersection via the communication with the at least one standard traffic signal and the at least one standard walk light;

wherein each of said at least one additional pedestrian warning signals is configured to function along with an existing traffic signal system;

whereby:

the system is configured where the motorist know that jumping a red signal will hurt a pedestrian;

the system is configured to provide awareness of the certain presence of the pedestrian at the traffic intersection due to a blinking white signal;

the system is configured to enable the motorist to be more attentive or less distracted while taking left or right turns;

the system is configured to warn and inform the motorist trying to take a right turn at the intersection;

the system is configured to warn and inform the motorist trying to take a left turn at the intersection;

the system is configured to provide awareness of possible pedestrian conflict that will enable the motorist to be cautious thereby leading to the traffic intersection being safer for the pedestrian;

the system is configured to alert the motorist to approach the traffic intersection with extra caution even if the pedestrian is not directly visible as they will be aware of certain presence of the pedestrian;

the system is configured to alert the motorist to know the certain presence of the pedestrian even if they are blocked from their line of sight due to vehicles in a left lane; and the system is configured to alert the motorist to know the certain presence of the pedestrian even if they are blocked from their line of sight due to vehicles in a right lane;

wherein:

when the green light is on the at least one standard traffic signal and the solid hand light is on the at least one standard walk light, the pedestrian light of the at least one additional pedestrian warning signal is configured to be off, whereby the motorist is alerted to continue driving through the traffic intersection or turn right with caution, and the pedestrian is alerted to not cross the crosswalk and push the button to cross;

when the yellow light is on the at least one standard traffic signal and the solid hand light is on the at least one standard walk light, the pedestrian light of the at least one additional pedestrian warning signal is configured to be solid, whereby the motorist is alerted to stop if safe to do so, and the pedestrian is alerted to continue waiting as traffic is beginning to stop;

when the red light is on the at least one standard traffic signal and the walking person light is on the at least one standard walk light, the pedestrian light of the at least one additional pedestrian warning signal is configured to flash, whereby the motorist is alerted to stop and remain stopped as the pedestrian is in the crosswalk, and the pedestrian is alerted to start crossing the crosswalk while looking for traffic from both directions prior to crossing;

when the red light is on the at least one standard traffic signal and the blinking hand light is on the at least one standard walk light, the pedestrian light of the at least one additional pedestrian warning signal is configured to flash, whereby the motorist is alerted to stop and remain stopped as the pedestrian is in the crosswalk, and the pedestrian is alerted to continue crossing;

when the yellow light is blinking on the at least one standard traffic signal for an unprotected left turn, and the walking person light or blinking hand is on the at least one standard walk light, the pedestrian light of the at least one additional pedestrian warning signal is configured to flash, whereby the motorist is alerted of presence of the pedestrian on a left crosswalk on the intersection;

when the pedestrian light of the at least one additional pedestrian warning signal is configured to blink and be activated when the pedestrian push button is pressed only when the red light is on the at least one standard traffic signal, whereby the pedestrian light of the at least one additional pedestrian warning signal will not switch on when the green light or the yellow light is on the at least one standard traffic signal; and when the solid hand light is on the at least one standard walk light, the pedestrian light of the at least one additional pedestrian warning signal will turn off and not be visible to the motorist.

16. A pedestrian warning signal comprising:

a pedestrian light visible to a motorist at a traffic intersection, the pedestrian light is configured to be off, to be solid, and to blink, the pedestrian light is in communication with at least one standard traffic signal configured for directing the motorist through the traffic intersection;

the pedestrian light is also in communication with at least one standard walk light configured for directing the pedestrian for use on the crosswalk at the traffic intersection;

the pedestrian light includes a color code and a blinking feature, wherein the pedestrian light is white in color and has a signaling feature configured to switch on solid or blinking, where the blinking white signal is configured to catch attention of the motorist and explicitly let the motorist know that the pedestrian is crossing the traffic intersection via the crosswalk; and wherein, the pedestrian light is configured to warn the motorist of a certain presence of the pedestrian at the traffic intersection who are either about to cross or already crossing the traffic intersection.

17. The pedestrian warning signal of claim 16 being configured to function along with an existing traffic signal system.

18. A system to warn a motorist of a certain presence of a pedestrian in a crosswalk at a traffic intersection comprising:

at least one standard traffic signal configured for directing the motorist through the traffic intersection;

at least one standard walk light configured for directing pedestrians for use on the crosswalk at the traffic intersection; and at least one additional pedestrian warning signal with a pedestrian light configured to face the motorist, each of the at least one additional pedestrian warning signals is in communication with the at least one standard traffic signal and the at least one standard walk light;

wherein, each of the at least one additional pedestrian warning signals is configured to warn the motorist of the certain presence of the pedestrian at the traffic intersection who are either about to cross or already crossing the traffic intersection;

whereby:

the system is configured where the motorist know that jumping a red signal will hurt the pedestrian;

the system is configured to provide awareness of the certain presence of the pedestrian at the traffic intersection due to a blinking white signal;

the system is configured to enable the motorist to be more attentive or less distracted while taking left or right turns;

the system is configured to warn and inform the motorist trying to take a right turn at the intersection;

the system is configured to warn and inform the motorist trying to take a left turn at the intersection;

the system is configured to provide awareness of a possible conflict with the pedestrian that will enable the motorist to be cautious thereby leading to the traffic intersection being safer for the pedestrian;

the system is configured to alert the motorist to approach intersections with extra caution even if the pedestrian is not directly visible as they will be aware of certain presence of the pedestrian;

the system is configured to alert the motorist to know the certain presence of the pedestrian even if they are blocked from their line of sight due to vehicles in a left lane;

the system is configured to alert the motorist to know the certain presence of the pedestrian even if they are blocked from their line of sight due to vehicles in a right lane;

or combinations thereof.

* * * * *